United States Patent [19]

DeShon

[11] 4,118,344

[45] Oct. 3, 1978

[54] DRYCLEANING DETERGENT SOLUTION

[75] Inventor: Harold D. DeShon, Midland, Mich.

[73] Assignee: The Dow Chemical Company, Midland, Mich.

[21] Appl. No.: 809,502

[22] Filed: Jun. 23, 1977

Related U.S. Application Data

[63] Continuation-in-part of Ser. No. 688,803, May 21, 1976, abandoned.

[51] Int. Cl.[2] ..... C11D 1/83; C11D 7/30; C11D 7/50

[52] U.S. Cl. ..... 252/559; 252/558; 252/170; 252/171; 252/DIG. 1; 252/DIG. 15

[58] Field of Search ..... 8/142; 252/558, 559, 252/170, 171, DIG. 1, DIG. 15

[56] References Cited

U.S. PATENT DOCUMENTS

| | | | |
|---|---|---|---|
| 2,806,001 | 9/1957 | Fong et al. | 252/550 |
| 3,091,508 | 5/1963 | Edwards | 8/142 |
| 3,222,286 | 12/1965 | Barnes | 252/559 |
| 3,272,754 | 9/1966 | Jaccard | 252/559 |
| 3,640,881 | 2/1972 | Moussali | 252/171 |
| 3,737,387 | 6/1973 | Marple | 252/170 |
| 3,907,496 | 9/1975 | Néel et al. | 8/142 |

OTHER PUBLICATIONS

Fong, W. et al., "Prevention of Soil Redeposition in Textile Cleaning Operations by Proteins and Other Polymeric Materials", Textile Research Journal, Nov. 1953, pp. 769–775.

*Primary Examiner*—P.E. Willis, Jr.
*Attorney, Agent, or Firm*—Glwynn R. Baker

[57] ABSTRACT

The detergent action and antiredeposition properties of a drycleaning solvent containing sodium petroleum sulfonate are improved by the addition of a small amount of high molecular weight polyglycol. Perchloroethylene solutions of the anionic detergent and polyglycols of 15,000 and 50,000 molecular weight made from mixed ethylene and propylene oxides are specifically disclosed.

7 Claims, No Drawings

DRYCLEANING DETERGENT SOLUTION

CROSS-REFERENCE TO RELATED APPLICATION

This is a continuation-in-part of my copending application Ser. No. 688,803 filed May 21, 1976, now abandoned.

BACKGROUND OF THE INVENTION

The present invention relates to drycleaning solvent compositions having improved detergent activity and antiredeposition properties. More particularly, it relates to drycleaning solvent solutions containing an anionic detergent and a polyglycol additive.

It is well known that the cleaning properties of a drycleaning solvent are enhanced by the presence of a dissolved soap or synthetic detergent. It is also known that these properties are further improved by the addition of a small amount of a low molecular weight polyol to such a solution. Edwards, U.S. Pat. No. 3,091,508 describes drycleaning solvent compositions containing detergent esters and polyglycols with molecular weights in the range of 200–1000. Barnes, U.S. Pat. No. 3,222,286 discloses somewhat similar drycleaning solvent compositions containing an arylsulfonate and a polyglycol ether of about the same range of molecular weight.

SUMMARY OF THE INVENTION

It has now been found that for solutions of certain anionic detergents in drycleaning solvents, the addition of a small amount of a polyglycol having a very high molecular weight in the range of about 10,000–100,000 not only markedly improves the detergency of the solutions as compared to the effect of polyglycols of lower molecular weight, but also adds excellent antiredeposition properties not shown by somewhat similar prior art compositions. The anionic detergents are generally described as alkali metal long chain alkyl aromatic sulfonates, particularly those known as petroleum sulfonates, sometimes called mahogany sulfonates, which are essentially alkylbenzenesulfonates where the alkyl group contains about 16–24 carbon atoms and where the term alkali metal includes any of that group plus ammonium. Specifically, the improved drycleaning composition consists essentially of a drycleaning solvent containing about 0.1–4 percent by weight of petroleum sulfonate, preferably the sodium salt, and about 0.01–0.4 percent of a polyoxyalkylene glycol of average molecular weight in the described range, and preferably in the range of about 12,000–60,000, wherein the oxyalkylene groups are mixed oxyethylene and oxypropylene groups.

DETAILED DESCRIPTION

While any drycleaning solvent can be used, that is, hydrocarbons such as naphtha or Stoddard's Solvent and halogenated lower aliphatic hydrocarbons such as carbon tetrachloride, perchloroethylene, tetrachlorodifluoroethane, and trichloroethylene, the halogenated hydrocarbons are preferred and perchloroethylene is most preferred. The term "halogenated lower aliphatic hydrocarbon" is used herein to mean hydrocarbons of 1–3 carbon atoms having one or more fluorine and/or chlorine substituents.

The preferred concentration of sulfonate detergent is about 0.5–2 percent by weight of solvent with the concentration of polyglycol about one-tenth of that amount. These proportions can be varied within the general limits cited for particular cleaning problems.

The mixed ethylene-propylene polyglycol component can be either a block or random copolymer, ordinarily using an appropriate glycol, polyglycol, or other polyol starter. Water could be used as the starter, but it is usually less convenient. Mixed polyglycols of about 5–95 mole percent oxyethylene units and 95–5 mole percent oxypropylene units are preferred and most preferably a polyglycol containing about 50–90 mole percent of oxyethylene units is used. As disclosed above, such polyglycols of about 10,000 to about 100,000 average molecular weight are useful in the invention and a polyglycol having an average molecular weight of about 12,000–60,000 is preferred. The conventionally used weight average molecular weight as determined by viscosity measurement is referred to herein.

TEST PROCEDURE

A 600-ml portion of a solution of sodium petroleum sulfonate (Penreco Petrosul 744-LC) and high molecular weight polyglycol in perchloroethylene was put in a Terg-o-tometer test beaker having a stirring spindle which rotated at 100 rpm. A quantity of 0.4 g. 200 mesh vacuum soil was dispersed in the solution. For antiredeposition testing, five test swatches 2 × 3 inches in size of cotton print cloth, wool gabardine, 100 percent polyester, and a 65 percent polyester-35 percent cotton permanent press blend were put in the solution, also a standard carbon soil swatch (4 × 4-inch wool — Foster D. Snell artificially soiled) for carbon soil removal determination. After agitation for 20 minutes, the swatches were removed from the solution, air-dried, and the reflectance of each dry swatch was measured using a photometer with a green Tristimulus filter and compared to that of the corresponding blank swatch. Results are listed as percentages of the blank reading, taken as 100 percent.

EXAMPLES 1–2

Solutions of sodium petroleum sulfonate (744-LC) and high molecular weight polyglycol in perchloroethylene were made up in the following proportions:

| Solution 1 | |
|---|---|
| Na petroleum sulfonate | 0.9 g. |
| Polyglycol A* | 0.1 g. |
| perchloroethylene | 100 g. |
| **Solution 2** | |
| Na petroleum sulfonate | 0.9 g. |
| Polyglycol B** | 0.1 g. |
| perchloroethylene | 100 g. |

*Polyglycol A - 85:15 mole ratio ethylene oxide:propylene oxide mixture condensed with propylene glycol, molecular weight (average) 50,000.

**Polyglycol B - similar to A but a 75:25 mole ratio of ethylene oxide to propylene oxide, average molecular weight about 15,000.

These solutions were tested for carbon soil removal and antiredeposition properties using the test procedure outlined above. A solution of 1 percent sodium petroleum sulfonate in perchloroethylene with no polyglycol additive was tested in the same way for purpose of comparison. The results listed in Table I are averages for the swatches run.

TABLE I

| Example No. | Polyglycol Additive | Antiredeposition Wool | Cotton | 65/35 P.P. | Polyester | Carbon Soil Removal |
|---|---|---|---|---|---|---|
| blank | none | 79.0 | 88.0 | 87.0 | 69.0 | 14.0 |
| 1 | A | 96.0 | 93.5 | 97.5 | 90.0 | 60.0 |
| 2 | B | 93.0 | 96.0 | 97.5 | 88.0 | 41.0 |

EXAMPLE 3

A Polyglycol A-sodium petroleum sulfonate solution made up as in Example 1 was compared to solutions made up in the same proportions using polyethylene glycol, molecular weight 400 (E-400) and polypropylene glycol, molecular weight 400 (P-400) respectively as the polyglycol additives. A blank sulfonate-perchloroethylene solution was also tested. The test procedure was as described above except that 0.3 g of vacuum soil in 600 ml of solution was used instead of the 0.4 g used previously. These results are listed in Table II.

TABLE II

| Polyglycol Additive | Antiredeposition Wool | Cotton | 65/35 P.P. | Polyester | Carbon Soil Removal |
|---|---|---|---|---|---|
| none | 96.0 | 97.5 | 96.0 | 86.5 | 24 |
| A | 97.0 | 97.5 | 99.0 | 91.5 | 48 |
| E-400 | 93.5 | 81.0 | 94.0 | 82.0 | 42 |
| P-400 | 89.0 | 90.5 | 93.5 | 80.0 | 41 |

Comparable antiredeposition and carbon soil removal results are obtained when the high molecular weight polyglycols used in Examples 1–3 are replaced by similar quantities of other polyglycols within the molecular weight and chemical structure limits defined for this invention. For example, a 50:50 ethylene oxide-propylene oxide polyglycol of 25,000 molecular weight, a 60:40 ethylene oxide-propylene oxide polyglycol of 75,000 molecular weight, and a 25:75 ethylene oxide-propylene oxide copolymer of about 20,000 molecular weight all give results similar to those shown above when substituted for the polyglycol component of Solution 1 or Solution 2.

I claim:

1. A composition consisting essentially of a drycleaning solvent having dissolved therein about 0.1–4 percent by weight of an alkali metal petroleum sulfonate and about 0.01–0.4 percent by weight of a polyoxyalkylene glycol having an average molecular weight of from about 10,000 to about 100,000 and wherein the polyoxyalkylene glycol contains about 95–5 mole percent oxyethylene units and about 5–95 mole percent oxypropylene units.

2. The composition of claim 1 wherein the drycleaning solvent is a halogenated lower aliphatic hydrocarbon.

3. The composition of claim 2 wherein the solvent is perchloroethylene.

4. The composition of claim 2 wherein the polyoxyalkylene glycol contains about 50–90 mole percent of oxyethylene units and about 50–10 mole percent of oxypropylene units.

5. The composition of claim 2 wherein the polyoxyalkylene glycol has an average molecular weight of about 12,000 to about 60,000.

6. The composition of claim 3 wherein the polyoxyalkylene glycol contains about 85 mole percent of oxyethylene units and about 15 mole percent of oxypropylene units and has an average molecular weight of about 50,000.

7. The composition of claim 3 wherein the polyoxyalkylene glycol contains about 75 mole percent of oxyethylene units and about 25 mole percent of oxypropylene units and has an average molecular weight of about 15,000.

* * * * *